US005588781A

United States Patent [19]

Smolinski et al.

[11] Patent Number: 5,588,781

[45] Date of Patent: Dec. 31, 1996

[54] LIGHTWEIGHT, WIDE-BODIED COMPLIANT TOWER

[75] Inventors: Susan L. Smolinski; Denby G. Morrison, both of Houston, Tex.; Peter W. Marshall, Stocksfield, England; David A. Huete, Spring, Tex.

[73] Assignee: Shell Oil Company, Houston, Tex.

[21] Appl. No.: 175,898

[22] Filed: Dec. 30, 1993

[51] Int. Cl.[6] ..... E02B 17/00

[52] U.S. Cl. ..... 405/195.1; 405/224

[58] Field of Search ..... 405/195.1, 203, 405/209, 211, 212, 224, 224.2, 224.3, 224.4, 227; 166/350, 359, 367; 175/7, 9

[56] References Cited

U.S. PATENT DOCUMENTS

| | | | |
|---|---|---|---|
| 3,952,526 | 4/1976 | Watkins et al. . | |
| 3,983,706 | 10/1976 | Kalinowski . | |
| 4,059,148 | 11/1977 | Blomsma | 166/359 |
| 4,117,690 | 10/1978 | Besse . | |
| 4,142,584 | 3/1979 | Brewer et al. | 175/7 X |
| 4,170,431 | 10/1979 | Wood . | |
| 4,216,834 | 8/1980 | Wardlaw | 175/7 |
| 4,234,270 | 11/1980 | Gjerde et al. . | |
| 4,240,506 | 12/1980 | Dareing | 166/367 |
| 4,273,470 | 6/1981 | Blomsma et al. | 405/202 |
| 4,348,137 | 9/1982 | Tuson et al. . | |
| 4,363,568 | 12/1982 | Schuh | 405/227 |
| 4,378,179 | 3/1983 | Hasle . | |
| 4,388,025 | 6/1983 | Evans | 405/212 |

(List continued on next page.)

FOREIGN PATENT DOCUMENTS

| | | | |
|---|---|---|---|
| 2123883 | 2/1984 | United Kingdom | 405/227 |
| 90/05236 | 5/1990 | WIPO | 166/367 |

OTHER PUBLICATIONS

PMB Engineering Inc. report commissioned by BP Exploration, Inc., "Maximum Case Compliant Tower Conceptual Design Study–Final Report," prepared Apr. 1991 (includes BP memorandum of Aug. 20, 1990 between T. G. Kint and G. M. Arenas).

Maus, Finn and Danaczko, "Exxon Structure Shows Compliant Piled Tower Cost Benefits," *Ocean Industry*, pp. 20–25 (Mar. 1986).

P. W. Marshall et al, Back–Span Stress Joint, *OTC* 7258, May 1983, pp. 485–495.

S. B. Hodges et al, A Comparison Of Methods For Predicting Extreme TLP Tendon Tensions, *OTC* 6887, May 1992, pp. 129–138.

R. G. Goldsmith et al, New Well System For Deepwater TLP Eases Production Operations, *SPE* 22769, Oct. 1991, pp. 95–108.

M. F. Allison, The Value Of Reservoir Test Systems (Exploratory Phase) In High–Cost Offshore Areas, *SPE* 22773, pp. 127–134.

J. E. Halkyard, Analysis Of Vortex–Induced Motions And Drag For Moored Bluff Bodies, *OTC* 6609, May 1991, pp. 461–468.

(List continued on next page.)

*Primary Examiner*—John A. Ricci
*Attorney, Agent, or Firm*—Mark A. Smith

[57] ABSTRACT

The present invention is a deepwater compliant platform that has enhanced dynamic characteristics by virtue of its wide stance, eliminates conventional conductor drivepipe guides and supporting framework, and reduces the net material requirements with a substantially open interior permitted in the absence of the conductor guides. This utilizes the wide body stance to accommodate a wide riser suspension corridor through the open interior thereby allowing suspended risers to be spaced apart sufficiently to avoid interference in response to normal tower motions.

20 Claims, 8 Drawing Sheets

U.S. PATENT DOCUMENTS

| | | | |
|---|---|---|---|
| 4,441,839 | 4/1984 | Baduel et al. | 405/202 |
| 4,505,620 | 3/1985 | Andrier . | |
| 4,519,726 | 5/1985 | Knowles et al. | 405/224.2 X |
| 4,576,516 | 3/1986 | Denison | 405/224.4 |
| 4,610,569 | 9/1986 | Finn et al. . | |
| 4,617,998 | 10/1986 | Langner | 166/367 X |
| 4,633,801 | 1/1987 | Marshall . | |
| 4,657,439 | 4/1987 | Petersen . | |
| 4,684,292 | 8/1987 | Danguy des Deserts et al. . | 405/227 X |
| 4,696,601 | 9/1987 | Davenport . | |
| 4,696,603 | 9/1987 | Danaczko et al. . | |
| 4,696,604 | 9/1987 | Finn et al. . | |
| 4,696,704 | 9/1987 | Takeuchi et al. . | |
| 4,702,321 | 10/1987 | Horton . | |
| 4,717,288 | 1/1988 | Finn . | |
| 4,721,417 | 1/1988 | Piazza et al. . | |
| 4,738,567 | 4/1988 | McGillivray et al. . | |
| 4,740,109 | 4/1988 | Horton . | |
| 4,793,739 | 12/1988 | Hasle et al. . | |
| 4,797,034 | 1/1989 | des Deserts et al. . | |
| 4,810,135 | 3/1989 | Davenport et al. . | |
| 4,818,145 | 4/1989 | Carruba | 166/367 X |
| 4,883,387 | 11/1989 | Myers et al. | 166/367 X |
| 4,927,296 | 5/1990 | Kaldenbach | 405/203 X |
| 4,934,872 | 9/1960 | Klausen | 405/227 |
| 4,958,960 | 9/1990 | Turner et al. . | |
| 5,147,148 | 9/1992 | White et al. | 405/224.2 X |
| 5,160,219 | 11/1992 | Arlt | 405/227 |
| 5,184,686 | 2/1993 | Gonzalez | 166/367 X |
| 5,190,411 | 3/1993 | Huete et al. . | |
| 5,195,848 | 3/1993 | Huete et al. . | |
| 5,199,821 | 4/1993 | Huete et al. . | |
| 5,207,534 | 5/1993 | Brasted et al. . | |

OTHER PUBLICATIONS

R. S. Glanville, Analysis Of The SPAR Floating Drilling Production And Storage Structure, *OTC* 6701, May 1991, pp. 57–68.

W. P. J. M. Kerckhoff et al, Minifloater: A Deepwater Production Alternative, Sep. 1990, vol. 25, No. 7, pp. 147–152.

Anon., "Eureka!", Offshore Engineer, Dec. 1990, pp. 11–13.

World In Focus, Offshore Engineer, Dec. 1990, pp. 7–8.

FIG. 2
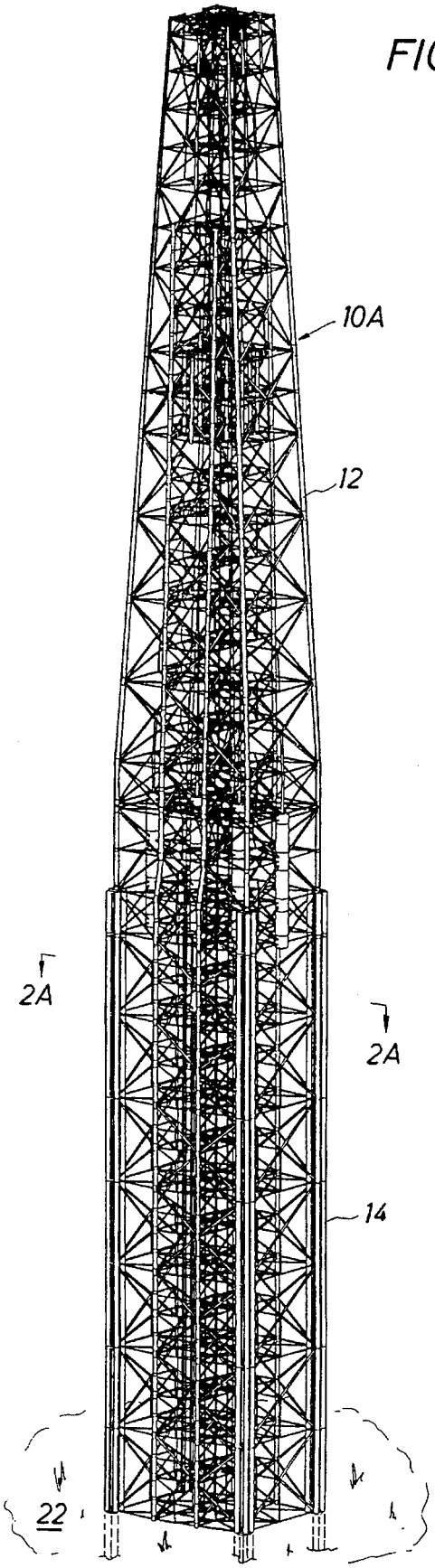
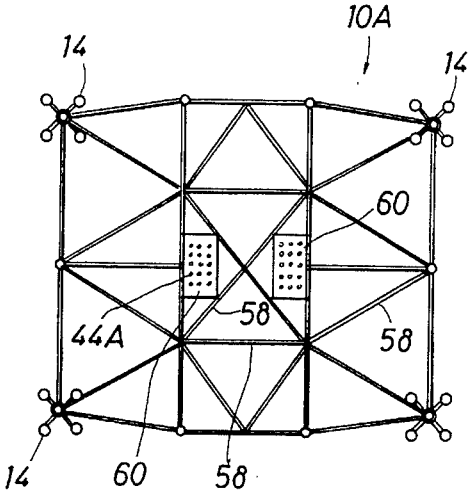
FIG. 2A

LIGHTWEIGHT, WIDE-BODIED COMPLIANT TOWER

BACKGROUND OF THE INVENTION

The present invention relates to an improved design for deepwater offshore platforms. More particularly, the present invention relates to an improved compliant tower design.

Compliant tower designs were developed for deepwater hydrocarbon prospects as an alternative to traditional bottom-founded platforms having fixed or rigid tower structures. While such rigid structures are effective to support topside facilities in relatively shallow to mid-depth waters, their underlying design premises become economically unattractive in developments much deeper than 1000 feet or so. Compliant towers were developed to provide bottom-founded structures in deeper water which are designed to "give" in a controlled manner in response to dynamic environmental loads rather than rigidly resist those forces. A basic requirement in controlling this response is to produce a structure having harmonic frequencies or natural periods that avoid those encountered in nature, e.g., waves. This has produced designs which, when compared with rigid platforms, substantially reduce the total amount of steel required to support topside facilities. Various approaches to altering the frequency response characteristics of such designs that have been proposed have often sought to further reduce loads and steel requirements with tightly constructed "slim" towers.

Nevertheless, these applications require great amounts of steel, and often a high percentage of this steel must be selected from premium grades and alloys. Thus, there remains substantial benefit to be gained from improvements that would safely further reduce this requirement for the amount of steel or beneficially alter the performance characteristics demanded of the steel supplied.

SUMMARY OF THE INVENTION

Toward the fulfillment of this need, the present invention is a lightweight, wide-bodied compliant tower for conducting hydrocarbon recovery operations from a deepwater offshore reservoir. Such a tower has a foundation and a compliant framework with a plurality of vertically extending legs secured thereto. The legs are interconnected with a minimum of horizontal bracing to complete the compliant framework in a manner that maintains a wide, substantially open riser suspension corridor extending substantially the entire length of the compliant framework. A topside facility is supported by the compliant framework and one or more risers is suspended from the vicinity of the topside facility, through the riser suspension corridor, to communicate with the reservoir.

The result is a deepwater compliant platform that has enhanced dynamic characteristics by virtue of its wide stance, eliminates conventional conductor guides and supporting framework, and reduces material requirements with a substantially open interior permitted in the absence of the conductor guides. This utilizes the wide body stance to accommodate a wide riser suspension corridor through the open interior thereby allowing suspended risers to be spaced apart sufficiently to avoid interference in response to normal tower motions.

BRIEF DESCRIPTION OF THE DRAWINGS

The brief description above, as well as further objects and advantages of the present invention will be more fully appreciated by reference to the following detailed description of the preferred embodiments which should be read in conjunction with the accompanying drawings in which:

FIG. 2 is a perspective view of a compliant tower design not benefitting from the present invention.

FIG. 2A is a cross section of the compliant tower of FIG. 2 taken at line 2A—2A in that figure.

DETAILED DESCRIPTION OF THE PREFERRED EMBODIMENTS

Figure 1:
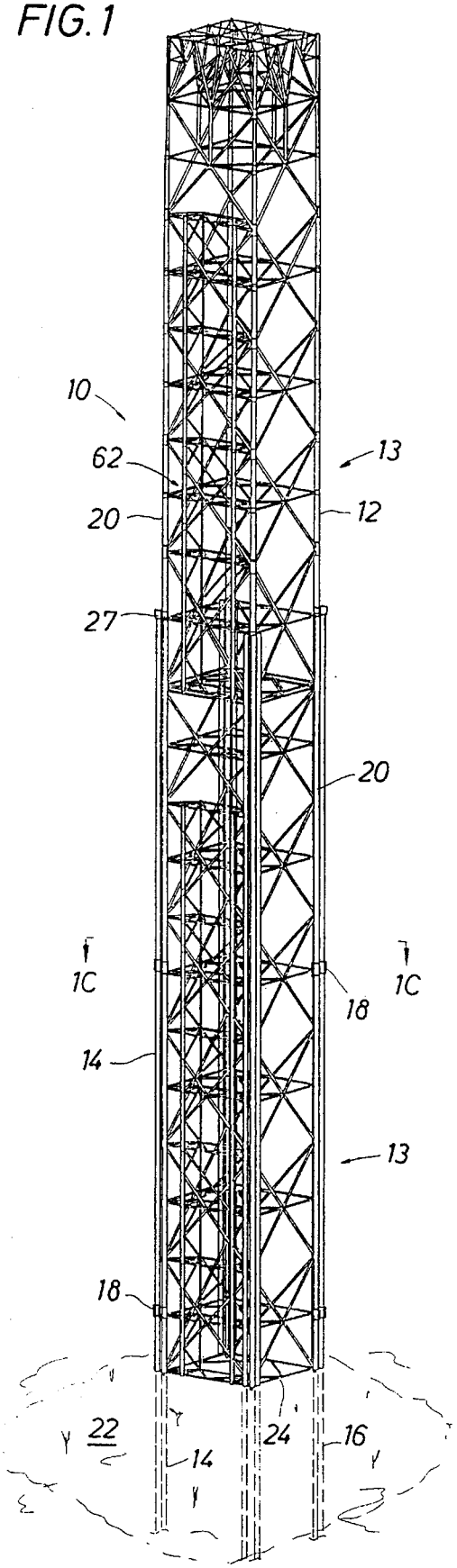
FIG. 1 is an isometric view of a lightweight, wide-bodied compliant tower constructed in accordance with the present invention.

FIG. 1 illustrates one embodiment of a lightweight, wide-bodied compliant tower 10 constructed in accordance with the present invention. The risers and topside facilities have been omitted from this figure for the sake of simplicity. This illustration is based on a preliminary design for thirty wells in 3000 feet of water, with a topside payload of 22,605 tons which includes 6000 tons of riser tension.

In this embodiment, a compliant framework 12 of tower 10 is provided in the form of a compliant piled tower in which piles or pilings 14 not only provide foundation 16 secured to ocean floor 22, but also extend a substantial distance above the mudline 24, along a substantial length of the compliant framework and thereby contribute significantly to both the righting moment and dynamic response of the overall compliant framework. Pilings 14 are slidingly received within sleeves 18 along legs 20 at the corners of compliant framework 12.

The tops of the pilings may be fixedly secured to the legs at pile receiving seats 27 by grouting or a hydraulically actuated interference fit. Minimal relative motions from non-storm conditions may be accommodated with an elastomeric grommet or bearing at the intersection of the pilings and sleeves. Larger motions are accommodated by the sliding connection.

Figure 1A:
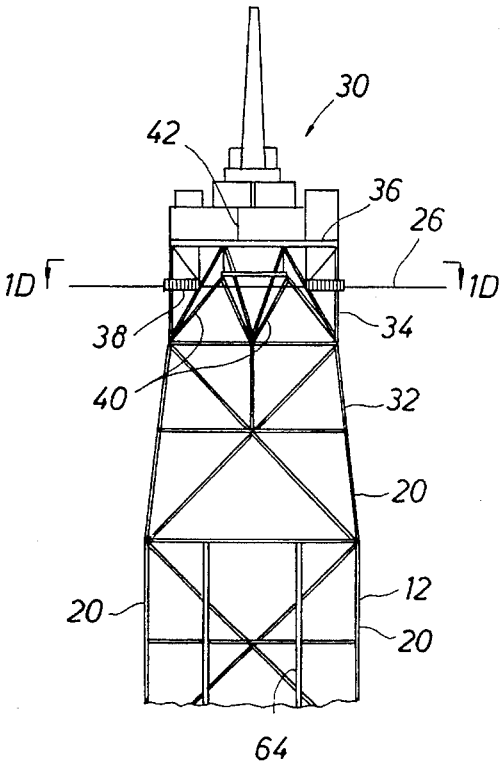
FIG. 1A is a side elevation view of the upper end of the lightweight, wide-bodied compliant tower of FIG. 1.

The upper end of this embodiment of lightweight, wide-bodied compliant tower 10 is illustrated in greater detail in FIG. 1A, here including topside facilities 30 which are supported above ocean surface 26. Topside facilities, as used broadly herein, may be as minimal as, e.g., a riser grid supporting Christmastrees or may include additional facilities, up to and including, comprehensive drilling facilities and processing facilities to separate and prepare produced fluids for transport. Legs 20 converge in a tapered section 32 which is provided in this embodiment because the topside facilities do not require the full wide body stance which is otherwise useful in contributing to the dynamic response characteristics of compliant framework 12. A platform base 34 joins the topside facilities to the top of the tapered section.

In this embodiment, platform base 34 not only supports a drilling deck 36 and other operations decks in the topside facilities, but it also retains boat decks 38 at its corners and includes a pyramid truss arrangement 40 through which the loads of the risers (not shown) are supported in tension from riser grid 42 or from the deck and directed to legs 20.

Figure 1C:
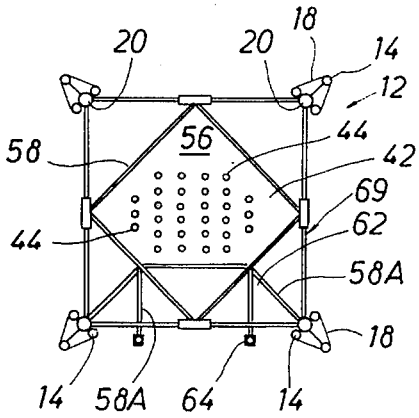
FIG. 1C is a cross section of the lightweight, wide-bodied compliant tower of FIG. 1 taken along line 1C—1C in FIG. 1.
Figure 1E:
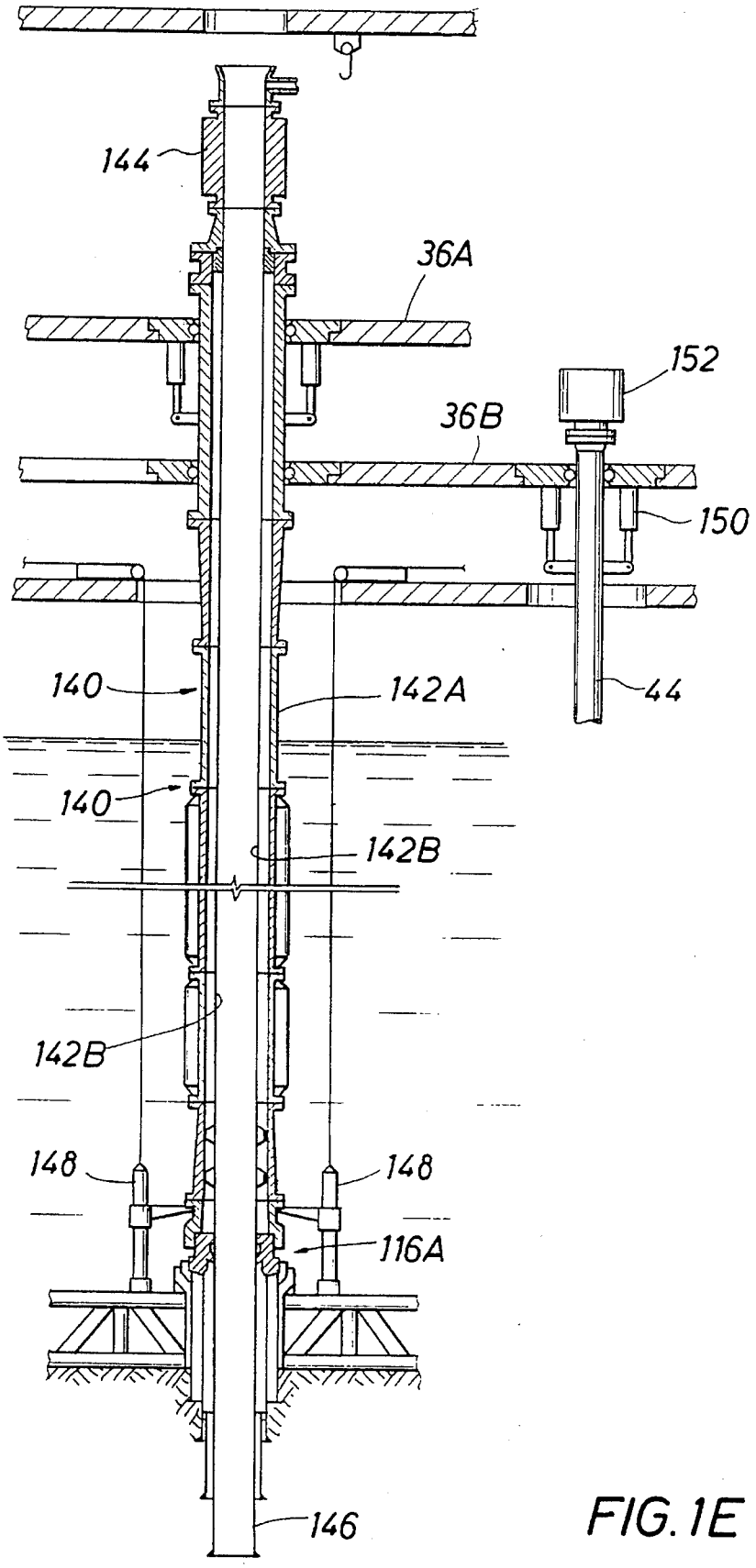
FIG. 1E is a partially cross sectioned view of a dual concentric string high pressure drilling riser which facilitates the practice of the present invention.
Figure 1B:
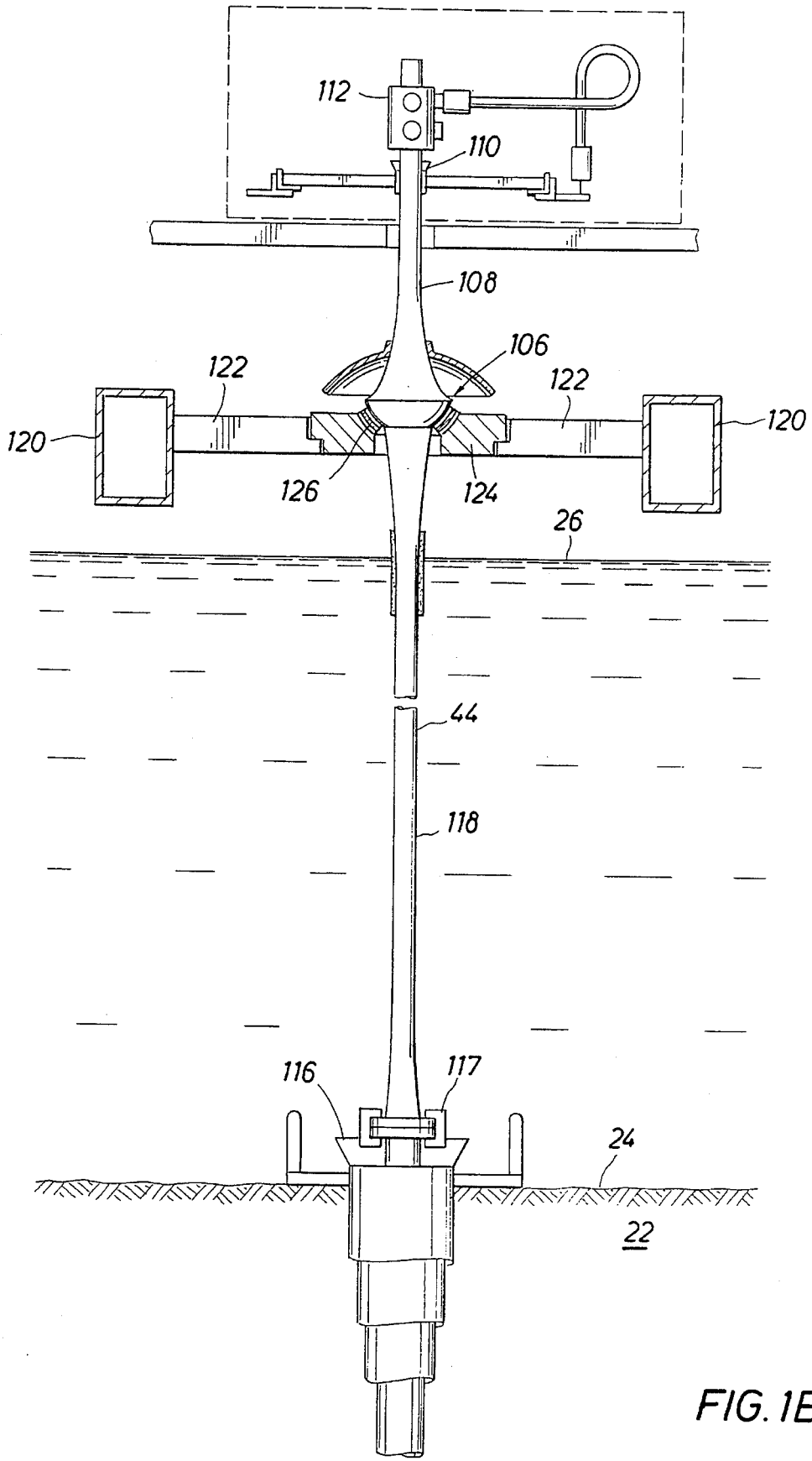
FIG. 1B is a close-up of a riser support in an embodiment of the present invention in accordance with FIG. 1A.

FIG. 1B is a close-up of an embodiment deploying a way of supporting a riser 44 through an intermediate tension relief connection 106 at riser grid 42. In this embodiment, the support system establishes a tension relieved backspan 108 in riser 44 which increases the flexibility of the riser as taught in U.S. patent application Ser. No. 057,076 filed by Peter W. Marshall on May 3, 1993 for a Backspan Stress Joint, the disclosure of which is hereby incorporated herein by reference and made a part hereof.

Riser 44 extends from a subsea wellhead 116 at sea floor 24 to riser grid 42 through a running span 118. The riser load is substantially transferred to riser grid 42 at intermediate tension relief connection 106. The riser grid comprises a grid of beams 120 and spanning plates 122 which is supported at the top of framework 12 by pyramid truss arrangement 40. Plate inserts 124 support the intermediate tension relief connection, here comprising a semispherical elastomeric bearing 126, joining the riser and the insert plates. The intermediate tension relief connection separates the full tension running span 118 of riser 44 from tension relieved backspan 108. The distal end of the backspan of the riser is substantially fixed at a restrained termination 110 adjacent surface wellhead 112. This arrangement allows flexure of highly tensioned, highly pressurized riser 44 between well guide or subsea wellhead 116 and surface wellhead 112 and isolates the required flexure from the restrained termination adjacent the surface wellhead thereby facilitating use of a fixed wellhead within a compliant tower.

Movement of the risers is suggested by the schematic representation of compliant tower 12 in FIG. 3C, discussed further below.

This riser support system carries the load of risers 44 in tension at or near the top of the risers. By contrast, well riser loads in offshore towers are traditionally carried in compression in the form of production casing or production tubing inside a relatively larger tube called a conductor or drivepipe, which is driven into the seabed and thus acts as an independent pile which is supported within the framework of the tower by conductor guides which are spaced at frequent intervals along the height of the tower. These conductor guides are necessary in the traditional support of riser loads to provide lateral support for conductors in order to prevent buckling and collapse.

The drivepipes/conductors of the conventional practice have a much larger diameter than necessary for the suspended production risers in ordinary applications of the present invention., e.g. traditionally these diameters have been on the order of 18–48 inches as opposed to 9 ⅝ inches or smaller for the later production risers. In part this diameter is needed in the conductors because the conductors of traditional design are set in place and used for both drilling and production operations.

In comparison, the present invention eliminates the need for the drivepipes or conductors and their conductor guides. This also eliminates the need for a great deal of the horizonal bracing which would conventionally be provided primarily to support those conductor guides, as well as vertical bracing to support the cathodic protection necessary for these elements.

FIG. 1C is a cross section of the compliant framework of the tower of FIG. 1, but includes risers 44. Here the risers pass through a large, open interior 56 of compliant framework 12. The top-tensioned risers extend through open interior 56 without the conventional support at regular intervals. This allows a possibility for greater relative motion between the risers and riser interference must be considered. However, the absence of conductor guides and the reduced need for horizontal bracing facilitates the economic deployment of a wide body compliant framework. This wide body stance accommodates a clearance between risers 44 that avoids interference without having to provide the conventional supports at regular intervals.

A "wide-bodied stance" is a relative relation between the height of the tower and the spacing of the legs. The area of the tower cross section is a function of this spacing and, for conventional geometries, a preferred range of "wide-bodiness" provides that the ratio of the total height ("L") of the compliant framework to the square root of the overall plan area of a cross section ("A") of the compliant framework be less than 12:1. However, this embodiment need not maintain this relation over the entire length of the compliant tower to achieve these benefits and a preferred range may be defined as meeting the relation of $$L/\sqrt{A} < 12$$

over at least 70% of the length of the compliant framework.

It is also desired to minimize the horizontal bracing while maximizing the relative size of the substantially open riser suspension corridor. This "openness" can be expressed as a function of the area of the substantially open riser suspension corridor in relation to the total area of the cross section of the compliant framework at that same horizontal level. A preferred degree of openness is achieved with the riser suspension corridor having a cross sectional area at least 22% that of the compliant framework along the entire length of the tower.

The illustrated embodiment also provides a method for reducing the environmental loading for the compliant tower. The compliant framework is installed having a plurality of legs, a minimum of horizontal bracing between the legs and a substantially open interior. The small diameter production risers are freely suspended in a top tensioned relation through the substantially open interior of the compliant framework. This construction enhances the transparency of the compliant tower to wave action and attendant environmental loading. This benefits foundation design by reducing the shear and moment requirements for the design sea states.

Eliminating conventional conductors and conductor guides also means that this infrastructure is not available to provide lateral support for conventional high pressure drilling risers that are vertically self-supporting but must be restrained from lateral buckling. This lateral support for such heavy drilling risers has been required in the past to allow well access for drilling operations through a surface blowout preventer ("BOP"). However, FIG. 1E illustrates a dual string concentric high pressure riser 140 that facilitates drilling operations through a suspended drilling riser system in the practice of an embodiment of the present invention. A lightweight outer riser 142A extends from above ocean surface 26 where it is supported by deck 36A of a deepwater platform to the vicinity of ocean floor 22 where it sealingly engages a subsea wellhead or well guide 116A. A high pressure inner riser 142B extends downwardly, concentrically through the outer riser to communicate with the well, preferably through a sealing engagement at subsurface wellhead 116A. Installation of the outer riser can be facilitated with a guide system 148. A surface blow out preventer ("BOP") 144 at the drilling facilities provides well control at the top of dual string high pressure riser 140.

This system permits use of lightweight outer riser 142A alone for drilling initial intervals where it is necessary to run large diameter drilling assemblies and casing and any pressure kick that could be encountered would be, at worst, moderate. Then, for subsequent intervals at which greater subterranean pressures might be encountered, high pressure inner riser 142B is installed and drilling continues therethrough. The inner riser has reduced diameter requirements since these subsequent intervals are constrained to proceed through the innermost of one or more previously set casings 146 of ever sequentially diminishing diameter. Further, outer riser 142A remains in place and is available to provide positive well control for retrieval and replacement of inner riser 142B should excessive wear occur in the inner riser.

Providing the high pressure requirements with smaller diameter tubular goods for inner riser 142B provides surface accessible, redundant well control while greatly diminishing the weight of the riser in comparison to conventional, large diameter, single string high pressure risers. This net savings remains even after including the weight of lightweight outer riser 142A. Further, the easy replacability of the inner riser permits reduced wear allowances and facilitates additional benefits by using tubular goods designed for casing to form high pressure inner riser 142B.

FIG. 1E also illustrates an alternative for the stress relieved backspan of FIG. 1B with tensioning system 150 supporting production riser 44 from a tree deck 36B. However, this tensioning system results in a moving surface wellhead 152 connected to facilities through flexible hoses and is not conducive to hard-piped connections that are suitable for a fixed surface wellhead.

The dual concentric string high pressure riser system of FIG. 1E is described in greater detail in U.S. patent application Ser. No. 167,100 filed by Romulo Gonzalez on Dec. 20, 1993, for a Dual Concentric String High Pressure Riser, the disclosure of which is hereby incorporated herein by reference and made a part hereof.

FIGS. 2 and 2A illustrate another design for a compliant tower 10A, also in the form of a wide body stance compliant piled tower. However, compliant tower 10A does not employ the present invention and is constrained to provide conductor guides and horizontal framing at frequent intervals. This design was examined for a water depth on the order of 3000 feet and a set of conductor guides were provided at intervals of about every 60 to 80 feet along this length. FIG. 2A is a cross sectional view taken at one of these conductor guide levels, showing the need for additional horizontal bracing 58 in support of conductor guides 60 within which conductors or drivepipes 44A are laterally constrained. Although these are not otherwise identical, a direct comparison of FIGS. 1C and 2A does provide a rough indication of the material savings in steel afforded, directly and indirectly, by the present invention, e.g., preliminary estimates of 66,000 tons as opposed to close to 100,000 tons of steel, respectively, in these preliminary tower designs for similar water depths. Each of these estimates excluded the steel in the foundations.

Returning to FIG. 1C, another steel saving design technique is illustrated in the preferred embodiment. Here temporary requirement for loads to be encountered during installation operations such as off-loading tower sections 13 from a barge are accommodated by a "floating" launch truss 62. The launch truss includes bracing 58A and rails 64 and provides select reinforcement as an alternative to strengthening the overall structure to accommodate these temporary loads when the compliant framework is supported horizontally. This support function is somewhat complicated in that rails 64 may be set inboard, rather than vertically aligned with the corner legs during transport. This narrowed rail spacing supports horizontal transport of a wide body stance platform having sides exceeding the beam of available class transport barges. Further, this structural reinforcement offers continued benefit by installing the tower into an orientation such that launch truss 62 will reinforce the compliant tower in the direction of the critical environmental loads historically prevalent at the site of the prospect.

Figure 1D:
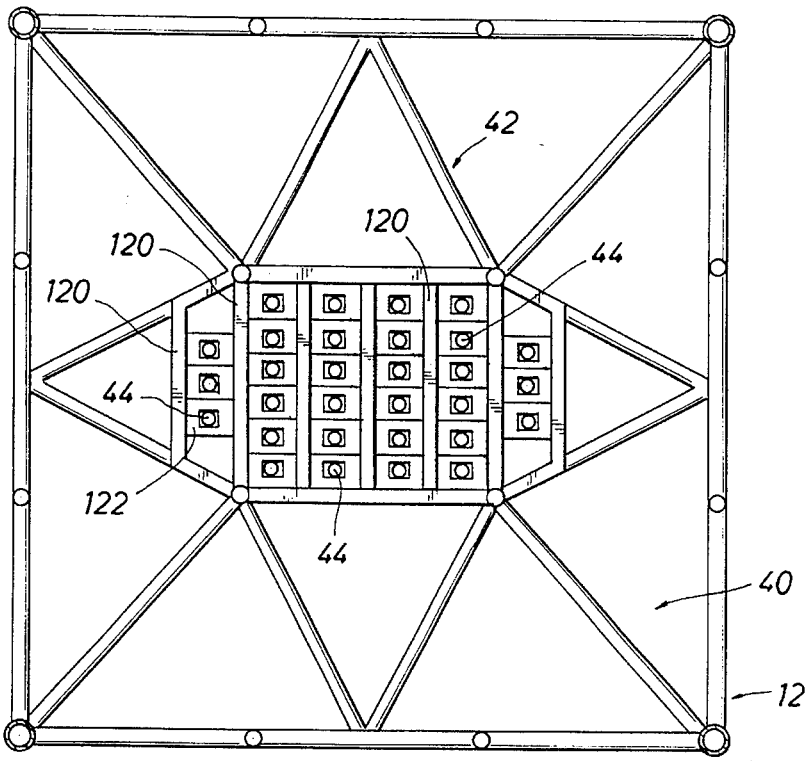
FIG. 1D is a cross section of the lightweight, wide-bodied compliant tower of FIG. 1 taken along line 1D—1D in FIG. 1A.
Figure 1F:
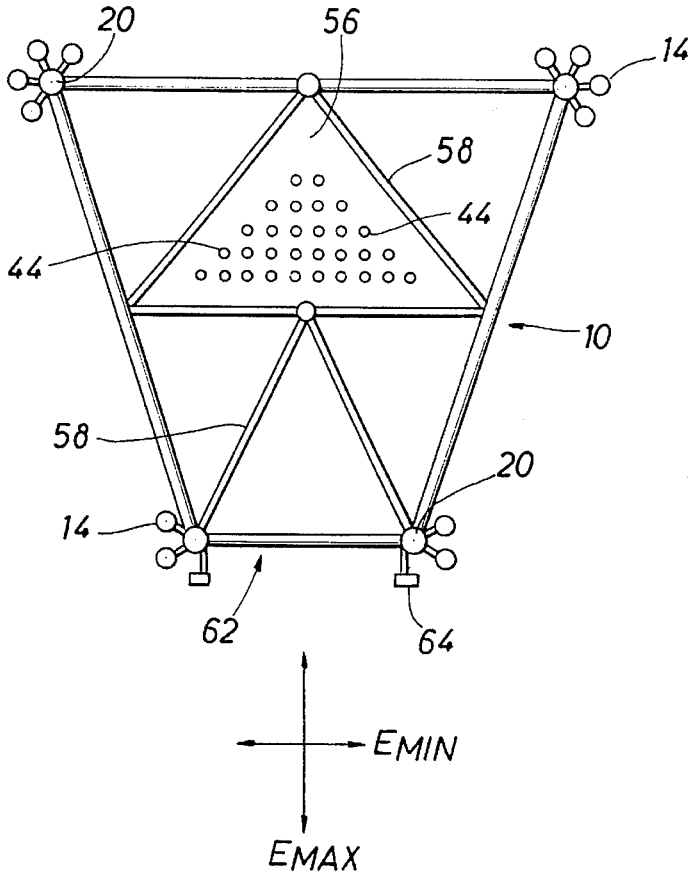
FIG. 1F is an end plan view of the embodiment of FIG. 1G in transport.
Figure 1G:
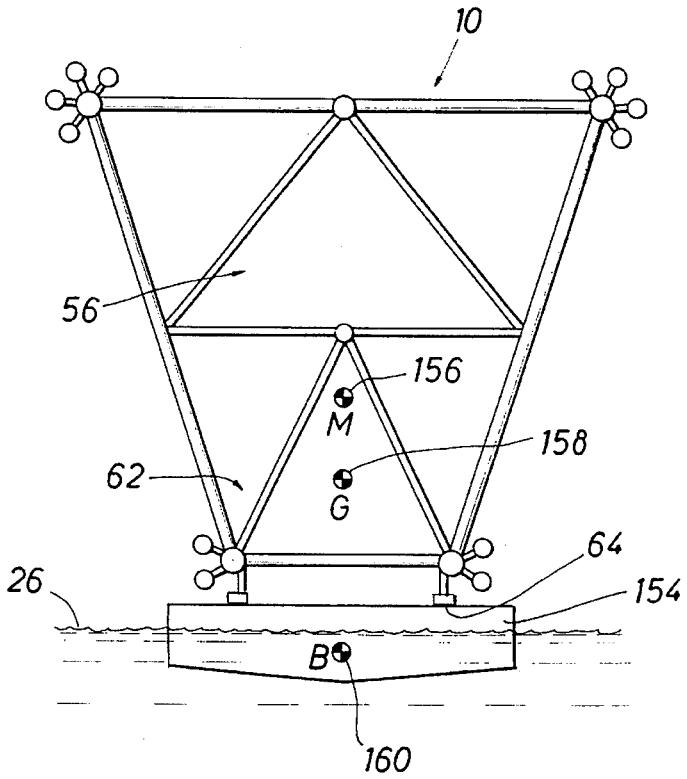
FIG. 1G is a horizontal cross section of the compliant framework of an alternate embodiment of the present invention.

FIGS. 1F and 1G illustrate another alternate embodiment of the present invention. FIG. 1F is a cross section of a compliant tower 10 in which legs 20 are arranged for a trapezoidal tower cross section having minimal horizontal bracing 58 and defining a substantially open triangular riser suspension corridor 56 through which risers 44 can run. This establishes an alternate integral launch truss arrangement 62 with launch skids 64 which is also directional in its structural reinforcement and can be oriented on installation such that it reinforces the compliant tower in the direction of the prevalent critical environmental loads, referenced here as $E_{max}$.

FIG. 1G illustrates the compliant tower of FIG. 1F in barge transport for installation. The trapezoidal cross section provides an inclined launch truss which facilitates the deployment of wider bodied towers with an existing fleet of relatively narrow barges 154. Preliminary analysis for this type of embodiment suggests suitable stability for the loaded and ballasted barge based on the alignment of the centers of buoyancy 160, gravity 158 and metacenter 156 with the center of gravity 156 sufficiently below the metacenter 156.

Figure 3A:
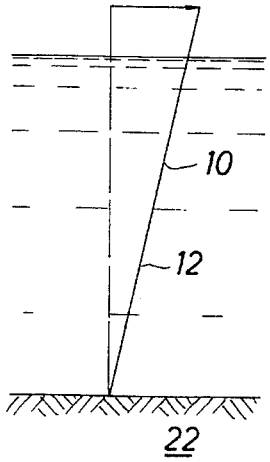
FIG. 3A is a schematic illustration of the sway mode response for a compliant tower.
Figure 3B:
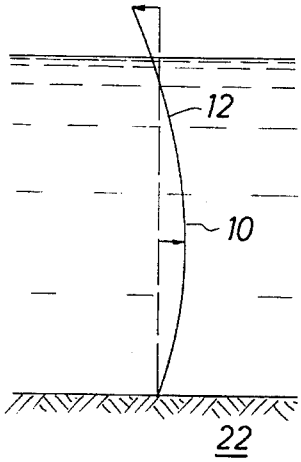
FIG. 3B is a schematic illustration of the whipping mode response for a compliant tower.

As noted above, compliant towers are designed to "give" in a controlled manner in response to dynamic environmental loads and this requires that the structure have harmonic frequencies that avoid those produced in nature. FIGS. 3A and 3B illustrate schematically the principle harmonic modes for a compliant framework 12 that are of critical design interest, higher order modes being far removed from driving frequencies that might be produced by wind, wave and current. Such forces are typically encountered at periods of 7 to 16 seconds in the Gulf of Mexico and designs strive for natural periods less than about 6 seconds or greater than about 22 seconds. A wave period distribution typical for portions of the Gulf of Mexico is graphically illustrated in FIG. 4A. Region 70 is that normally occurring and region 72 illustrates the shift in distribution for extreme storm events.

Returning to FIGS. 3A and 3B, FIG. 3A schematically illustrates the first mode, also called the fundamental, rigid body, or sway mode motion for a compliant tower 10. A given compliant tower will have a characteristic natural frequency for such motions. Further, a structure with non symmetrical response may have more than one sway mode harmonic frequency. The embodiment of FIG. 1, as analyzed in the preliminary design for a specific offshore prospect has a representative sway mode period of 41 seconds. This is considerably longer than the driving forces to be encountered in nature as is conventional in compliant tower design.

Figure 3C:
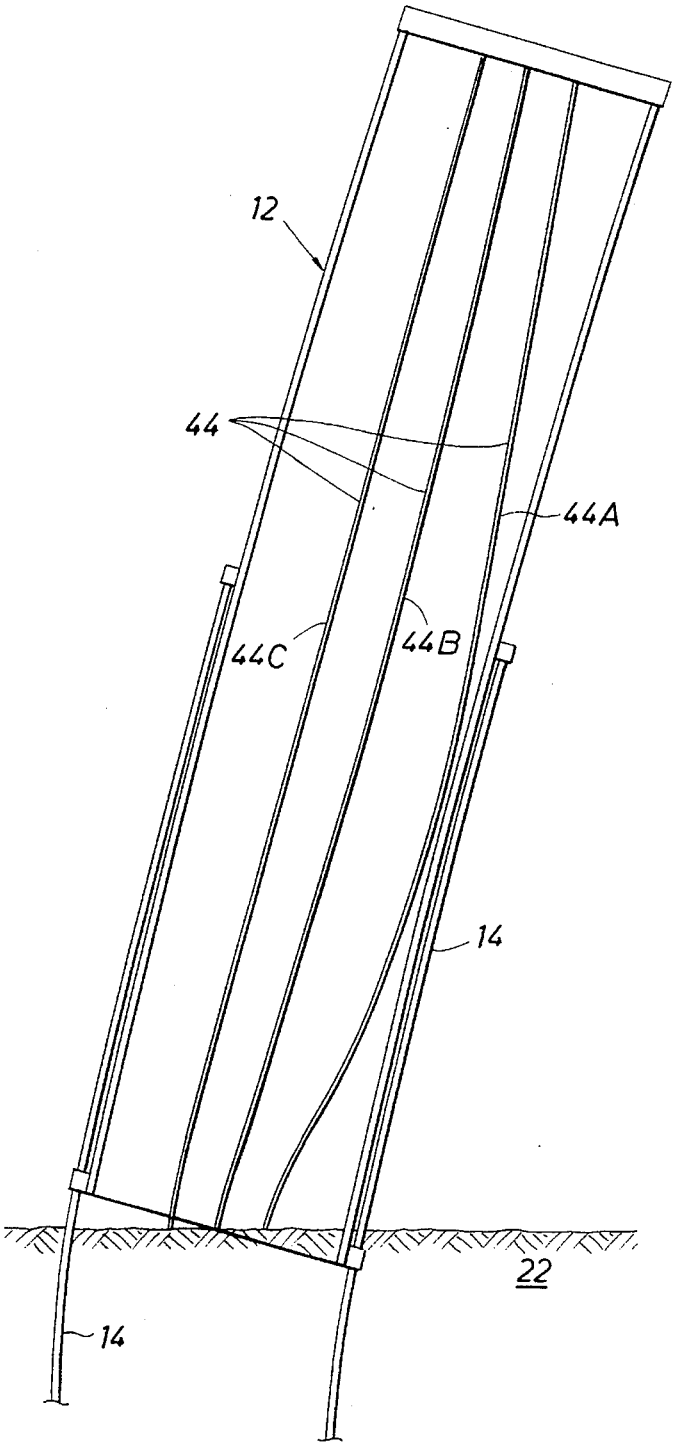
FIG. 3C is a schematic illustration of the sway mode response for a compliant tower having multiple top-tensioned, rigidly secured risers.

FIG. 3C illustrates schematically the effect of motion in the compliant framework 12 of a compliant tower upon a plurality of risers 44. Thus, motion of the compliant tower will tend to slacken some risers 44A while simultaneously increasing the tension in other risers 44C and leaving other risers 44B without a substantial change. The clearance provided the risers must accommodate this motion and accommodate dynamic response. Note also that variations in the riser tension will alter the dynamic response of respective risers, substantially complicating this analysis. Another aspect observable in this exaggerated drawing is angular deflection in the riser terminations.

FIG. 3B illustrates the first flexural mode motion, also called the second, bow-shaped or whipping mode response for a compliant tower 10. Again, non-symmetry may result in a plurality of harmonic frequencies for this whipping mode response. Avoiding the natural harmonic frequency of this response is often more of an engineering challenge than achieving a desirable sway mode.

Figure 4C:
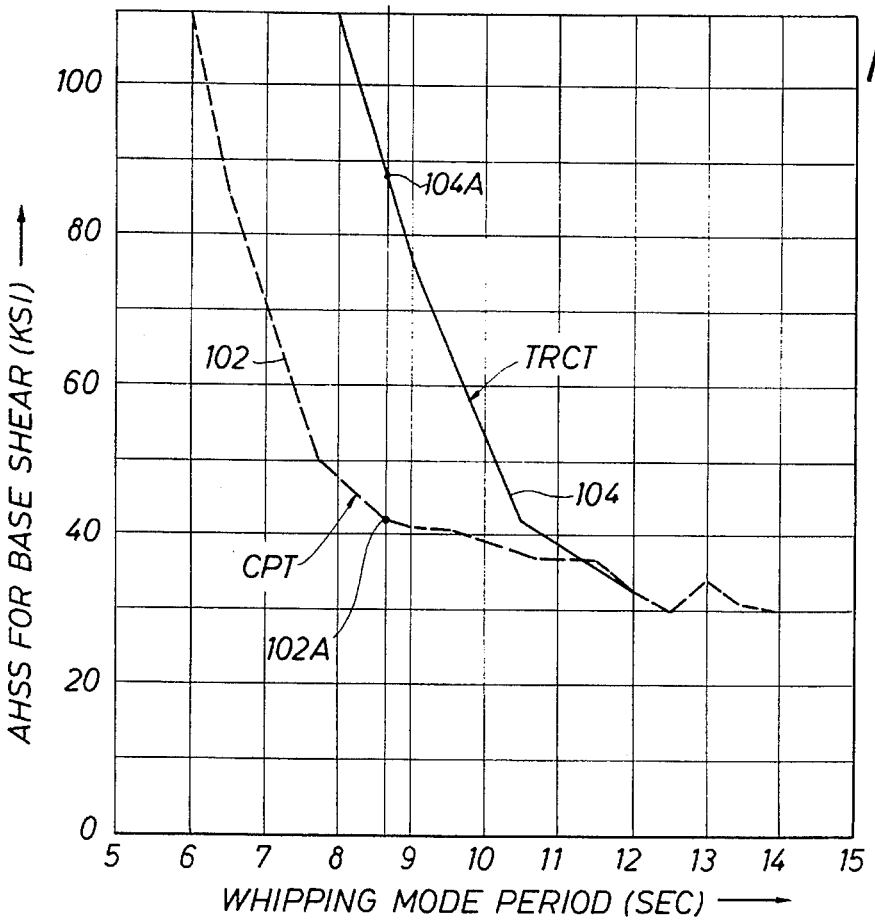
FIG. 4C is a graphical representation of the fatigue characteristics for two different compliant towers.
Figure 4A:
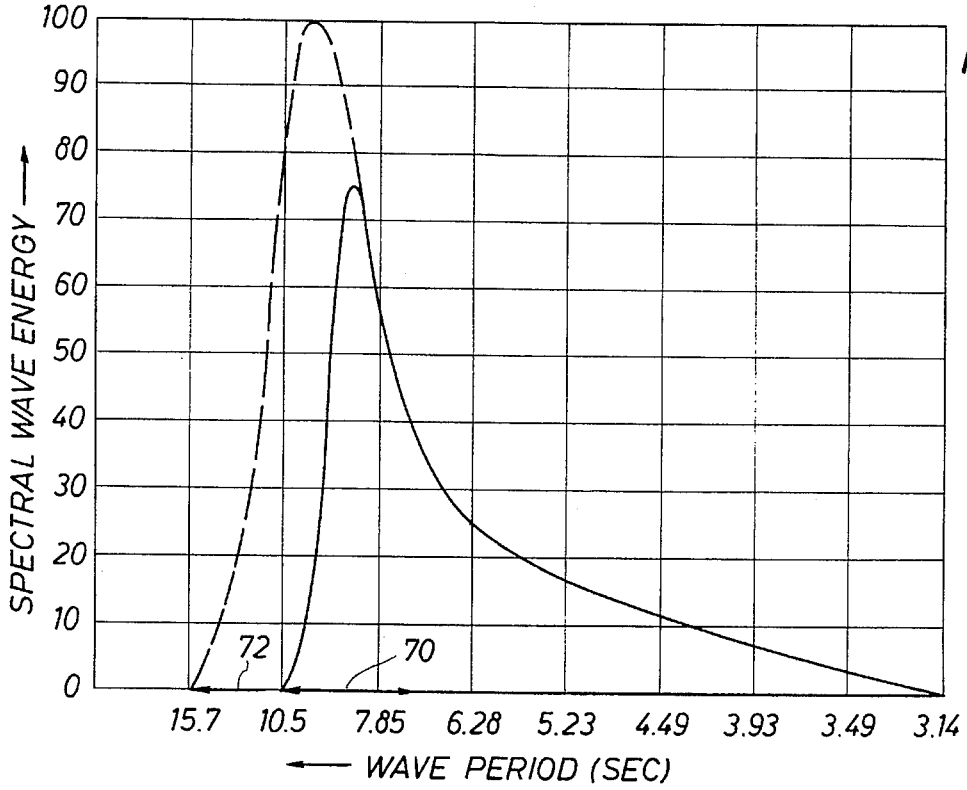
FIG. 4A is a graphical representation of wave frequency distribution in storm and non-storm situations.
Figure 4B:
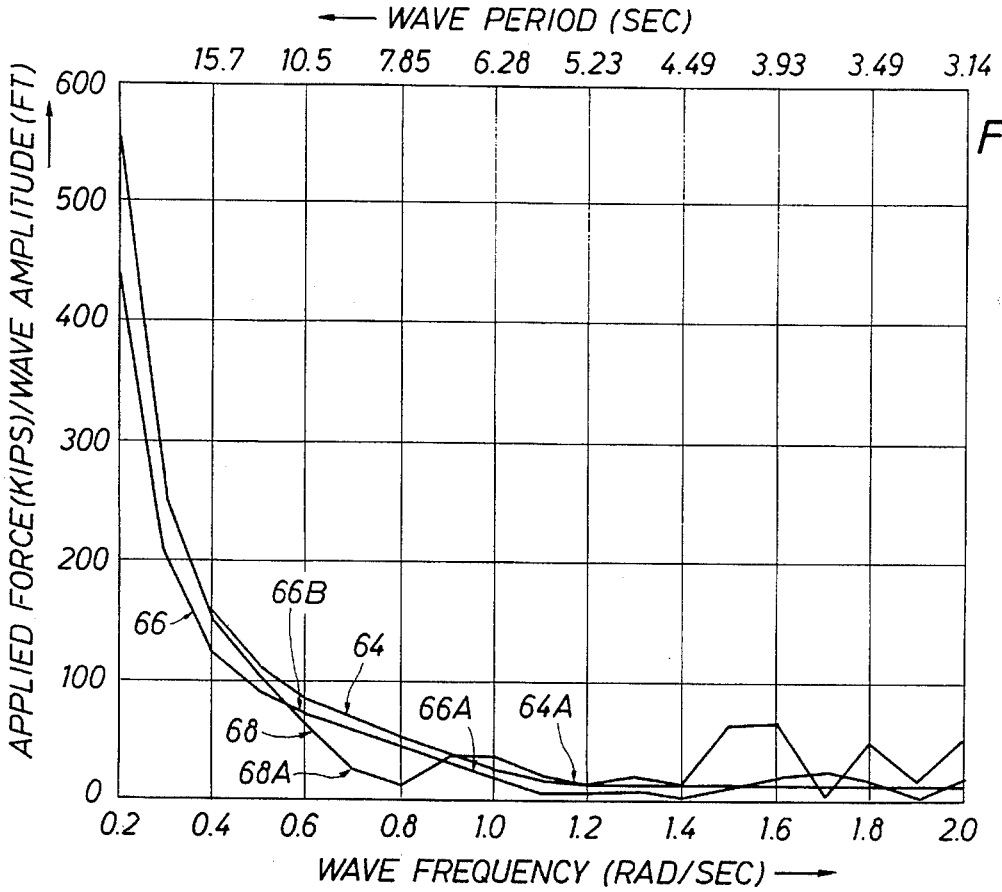
FIG. 4B is a graphical representation of the dynamic response characteristic of preliminary designs for three different deepwater structures.

FIG. 4B is a generalized graph illustrating the applied wave force characteristics of certain tower designs as a plot of an applied wave force transfer function against frequency. This relation is qualitatively represented in FIG. 4B by curve 64 for a fixed tower having a 140-foot wide stance at the waterline, by curve 66 for a compliant tower with a similar waterline geometry and by curve 68 for a 245-foot wide tensioned riser compliant tower in accordance with FIG. 1. Upward trends from low energy "valleys" in these transfer functions are indicated at points 64A, 66A and 68A, respectively, on these response curves. The fatigue requirements for each of these platforms increases rapidly for tower natural periods longer than these points. However, the response of this embodiment of the present invention is characterized by an additional "valley" of reduced relative applied force with respect to a narrower stance compliant tower.

Tightly compacted "slim towers" having a narrow body stance have been explored for opportunities to lower steel requirements. However, designing such structures has continued to require great amounts of structural steel, and often attempts to optimize these designs have resorted to higher, more expensive grades of steel. Even so, the dynamic response of these designs have been analyzed to be marginal due to high wave forces in resonance with their whipping mode response. A recent preliminary design effort for a slim tower having a body only 140 feet wide, for about 3000-foot water depth was analyzed to have a whipping mode natural period of about 10 seconds. It should also be noted that, despite its slim stance, this tower design (excluding piles) was estimated to require 125,000 tons of steel, in contrast to 66,000 tons in a preliminary design in accordance with the present invention in a similar application.

A wide body stance has been pursued as one approach to keeping the whipping mode natural period from getting so long that dynamic amplification and fatigue become problems. However, such an approach of widening the stance, i.e. the width of the body, of the tower in accordance with the conventional drivepipe or conductor guide practice adversely affects the project economics due to substantial increases in the steel requirements. Even accepting this drawback, the dynamic response of such a compliant tower could still prove unacceptable in application to an otherwise suitable prospect if conventional conductors, topside arrangements, and waterline dimensions are used. Such a case is illustrated with the dynamic response characteristics of curve 66 in FIG. 4B which was calculated for the preliminary design of the compliant tower of FIG. 2. That design was for forty wells in almost 3000 feet of water. This design attempt concluded with a whipping mode natural period estimated at 10.6 seconds and required the conclusion that this could prove subject to dynamic amplification. See point 66B in relation to the rising energy levels on curve 66 in FIG. 4B.

Therefore, another aspect of the present invention becomes important. Not only does a wide-bodied tensioned riser compliant tower result in a net steel savings over an otherwise similar tower which supports the risers in conductor guides, it actually further improves the dynamic response characteristics.

Referring again to FIG. 3C, the motions of top-tensioned risers 44 are shown to move independently of compliant framework 12 in dynamic response. Thus, the present invention not only removes the unnecessary internal bracing from the mass of the compliant framework along its length, it also effectively removes the mass of the risers. This may prove significant as demonstrated by the illustrated example in which 40 conventional 30-inch drivepipes would have a combined effective mass of about 70,000 tons which is comparable to the weight of the steel in the tower jacket itself. The whipping mode response of compliant towers is relatively insensitive to variations in the load at the topside facilities and allowing the risers to extend substantially freely through the compliant framework 12 effectively decouples the mass of risers 44 from that which defines the whipping mode response of compliant tower 10.

Further, eliminating the conductor guides and attendant horizontal bracing produces a substantially more open interior to a wide-bodied compliant tower. These openings, in combination with a wide stance at the waterline, permits waves to pass through, impacting on the far side substantially out of phase with the force of wave impact applied on the leading side. Thus, "wave cancellation" is another benefit to the dynamic response of a compliant tower which is substantially enhanced by the present invention. Strategic placement of wave impacting structure, such as by placing boat docks 38 in FIG. 1A on the periphery, may further enhance this effect.

This enhanced wave cancellation can greatly improve the fatigue characteristics of a compliant platform. FIG. 4C illustrates a hot spot stress analysis of two compliant platforms having similar natural whipping mode periods at approximated 8.50 to 8.75 seconds. Calculations in accordance with API methodology for "Allowable Hot Spot Stress" as a function of base shear and at the natural whipping mode period is used as an indication of relative fatigue life for an offshore platform. Here curve 102 represents a platform design that was preliminarily analyzed which did not enhance wave cancellation through the practice of the present invention. The allowable hot spot stress for shear is indicated at the intersection of this curve and the whipping mode period, i.e., at point 102A. Compare the significantly higher allowable hot spot stress indicated by curve 104 intersecting the natural period for whipping mode response at point 104A. The higher allowable stress permits a lighter design.

Combining the benefits of decoupling the mass of the risers from the dynamic response of the tower and the benefits of enhanced wave cancellation can produce a significantly improved dynamic response for a compliant tower. Compare the response curves 68 and 66 in FIG. 4B for otherwise substantially similar compliant towers, particularly noting rising wave force response curves at points 8A and 66A, respectively. Towers with shorter whipping periods are resonantly excited by a reduced wave force.

This aspect of the present invention is also suggested by a comparison of lightweight, wide-bodied compliant tower 10 of FIGS. 1–1D and conventional wide-bodied compliant tower 10A of FIGS. 2 and 2A. The compliant tower design of FIG. 2 was calculated to have a whipping mode harmonic frequency at 10.1 to 10.6 seconds, depending upon the axis of the structure. This period was judged unacceptable in that natural environmental forces could become amplified in harmonic response. By contrast, the lightweight, wide-bodied compliant tower of FIG. 1 is calculated in an application to have a substantially improved 8.5 second whipping mode period. Although these cases are not otherwise identical, decoupling the risers from the compliant framework provides significant impact in the overall dynamic response of the compared designs.

The advantages of eliminating conductor or drivepipe guides, wide waterline geometry, and decoupling the conductor mass from the distributed mass which participates in the whipping mode, have been illustrated with a compliant piled tower design. However, a full range of compliant towers, including but not limited to, flextowers, flextowers with trapped mass (water), and buoyant towers, could benefit from the application of the present invention.

Other modifications, changes and substitutions are intended in the forgoing disclosure and in some instances some features of the invention will be employed without a corresponding use of other features. Accordingly, it is appropriate that the appended claims be construed broadly and in the manner consistent with the spirit and scope of the invention herein.

What is claimed is:

1. A lightweight, wide-bodied compliant tower for conducting hydrocarbon recovery operations from a deepwater offshore reservoir, comprising:

a foundation;

a compliant framework, comprising:

a plurality of vertically extending legs secured to the foundation; and a plurality of horizontal bracing directly interconnecting the legs in a manner defining a substantially open riser suspension corridor extending substantially the entire length of the compliant framework without regular vertical intervals of riser load transfer structure; and a topside facility supported by the compliant framework.

2. A lightweight, wide-bodied compliant tower for conducting hydrocarbon recovery operations from a deepwater offshore reservoir, comprising:

a foundation;

a compliant framework, comprising:

a plurality of vertically extending legs secured to the foundation; and a plurality of horizontal bracing interconnecting the legs in a manner maintaining a substantially open riser suspension corridor extending substantially the entire length of the compliant framework;

a topside facility supported by the compliant framework; and a freely suspended riser extending through the riser suspension corridor from the vicinity of the topside facility to communicate with the reservoir.

3. A lightweight, wide-bodied compliant tower in accordance with claim 2 further comprising a plurality of the risers.

4. A lightweight, wide-bodied compliant tower in accordance with claim 3, further comprising:

a riser grid positioned between the compliant framework and the topsides and vertically aligned with the riser suspension corridor; and a pyramid truss connecting the riser grid to the legs of the compliant framework.

5. A lightweight, wide-bodied compliant tower in accordance with claim 3 further comprising a plurality of the riser suspension corridors.

6. A lightweight, wide-bodied compliant tower in accordance with claim 3 wherein the foundation comprises the lower ends of a plurality of piles anchored in the sea floor and wherein the compliant framework further includes the upper ends of the piles extending adjacent and engaged to the legs along a substantial portion of the height of the compliant framework.

7. A lightweight, wide-bodied compliant tower in accordance with claim 2, wherein the compliant framework further comprises a longitudinally extending launch truss.

8. A lightweight, wide-bodied compliant tower for conducting hydrocarbon recovery operations from a deepwater offshore reservoir, comprising:

a foundation;

a compliant framework, comprising:

a plurality of vertically extending parallel legs secured to the foundation; and a plurality of horizontal bracing interconnecting the legs in a manner maintaining a substantially open wide body riser suspension corridor extending substantially the entire length of the compliant framework;

a topside facility supported by the compliant framework; and a plurality of freely suspended risers extending through the riser suspension corridor from the topside facility to communicate with the reservoir, said risers being spaced apart to provide clearance to prevent interference between the risers in response to normal flexure of the compliant tower.

9. A lightweight, wide-bodied compliant tower in accordance with claim 8, further comprising:

a riser grid positioned between the compliant framework and the topsides and vertically aligned with the riser suspension corridor; and a pyramid truss connecting the riser grid to the legs of the compliant framework.

10. A lightweight, wide-bodied compliant tower in accordance with claim 8, wherein the compliant framework further comprises a longitudinally extending launch truss.

11. A lightweight, wide-bodied compliant tower in accordance with claim 8 wherein the foundation comprises the lower ends of a plurality of piles anchored in the sea floor and wherein the compliant framework further includes the upper ends of the piles extending adjacent and engaged to the legs along a substantial portion of the height of the compliant framework.

12. A compliant tower for conducting hydrocarbon recovery operations from a deepwater offshore reservoir, comprising:

a foundation;

a compliant framework, comprising:

a plurality of vertically extending parallel legs secured to the foundation;

a plurality of horizontal bracing interconnecting the legs; and a substantially open riser suspension corridor vertically extending substantially the entire length of the compliant framework without interruption by the horizontal bracing and having a horizontal cross sectional area of at least 22% that of the compliant framework;

a topside facility supported by the compliant framework; and a plurality of freely suspended risers extending through the riser suspension corridor from the topside facility to communicate with the reservoir, said risers being spaced to provide clearance to prevent interference between the risers and between the risers and the horizontal bracing in response to normal flexure of the compliant tower or normal environmental loads on the risers.

13. A compliant tower in accordance with claim 12 wherein the ratio of the height of the compliant framework to the square root of the area between the legs of the compliant tower adjacent the foundation is less than 12:1.

14. A method for economically reducing the natural period of the whipping mode harmonic response in a deepwater compliant tower having a vertically extending compliant framework secured to a foundation at an ocean floor and supporting a topside facility above the ocean surface and having a plurality of risers communicating between the topside facility and a plurality of wells at the ocean floor through a running span, the method comprising:

providing the compliant framework in a wide body configuration such that the following relation is met over at least 70% of the length of the compliant framework:

$$L/\sqrt{A} < 12$$

where:

L is the total length of the compliant framework; and

A is the area of a cross section of the compliant framework at a given elevation;

providing a substantially open vertically extending riser suspension corridor that is braced only at its periphery; and suspending the risers in a top-tensioned relation from a riser support at the top end of the compliant framework and deploying the running spans of the risers through the riser suspension corridor without supplying intermediate supports at regular intervals along the compliant framework.

15. A method for economically reducing the natural period of the whipping mode harmonic response in accordance with claim 14 wherein a plurality of riser suspension corridors are provided.

16. A method for economically reducing the natural period of the whipping mode harmonic response in accordance with claim 15, further comprising:

incorporating a launch truss into the compliant framework; and orienting the launch truss to directionally strengthen the compliant framework in the direction of the prevailing environmental loads upon installation of the compliant tower.

17. A method for improving the fatigue characteristics of a compliant tower by enhancing a wave cancellation effect, comprising:

establishing a compliant framework having a plurality of legs interconnected with a plurality of horizontal bracing in a manner which maintains a substantially open riser suspension corridor extending through the compliant framework at least the full depth of the wave zone; and freely suspending risers through the riser suspension corridor;

the compliant framework and freely suspended risers presenting surfaces such that waves impact a first side of the compliant tower, pass through the risers and the interior of the compliant framework substantially unimpeded, and impact a second side of the compliant tower with a force which is significant in relation to the force of the impact on the first side.

18. A method for improving the fatigue characteristics of a compliant tower in accordance with claim 17, further comprising providing a wide stance at the waterline such that the first and second sides of the compliant tower are at a relative distance for which significant wave action impacts the first and second sides substantially out of phase.

19. A method for improving the fatigue characteristics of a compliant tower in accordance with claim 17, further comprising placing a plurality of wave impacting structures on the periphery of the complaint tower.

20. A method for economically reducing the natural period of the whipping mode harmonic response in a deepwater compliant tower having a vertically extending compliant framework secured to a foundation at an ocean floor and supporting a topside facility above the ocean surface and having a plurality of risers communicating between the topside facility and a plurality of wells at the ocean floor through a running span, the method comprising:

providing the compliant framework in a wide body configuration such that the following relation is met over at least 70% of the length of the compliant framework:

$$L/\sqrt{A} < 12$$

where:

L is the total length of the compliant framework; and

A is the area of a cross section of the compliant framework at a given elevation;

providing a substantially open vertically extending riser suspension corridor that is braced only at its periphery; and incorporating a launch truss into the compliant framework; and orienting the launch truss to directionally strengthen the compliant framework in the direction of the prevailing environmental loads upon installation of the compliant tower.

* * * * *